US008083165B2

(12) United States Patent
Mangelberger et al.

(10) Patent No.: US 8,083,165 B2
(45) Date of Patent: Dec. 27, 2011

(54) METHOD AND DEVICE FOR MANUFACTURING DISPERSED MINERAL PRODUCTS

(75) Inventors: Thomas Mangelberger, Villach (AT); Bahman Tavakkoli, Puch (AT)

(73) Assignee: OMYA GmbH, Gummern (AT)

( * ) Notice: Subject to any disclaimer, the term of this patent is extended or adjusted under 35 U.S.C. 154(b) by 400 days.

(21) Appl. No.: 11/920,609

(22) PCT Filed: May 18, 2006

(86) PCT No.: PCT/EP2006/062425

§ 371 (c)(1), (2), (4) Date: Sep. 12, 2008

(87) PCT Pub. No.: WO2006/122967

PCT Pub. Date: Nov. 23, 2006

(65) Prior Publication Data

US 2009/0032628 A1 Feb. 5, 2009

(30) Foreign Application Priority Data

May 20, 2005 (DE) ..... 10 2005 023 950

(51) Int. Cl.
*B02C 23/08* (2006.01)

(52) U.S. Cl. ..... 241/79.1; 241/79

(58) Field of Classification Search ..... 241/79.1, 241/78, 79

See application file for complete search history.

(56) References Cited

U.S. PATENT DOCUMENTS

| | | | | |
|---|---|---|---|---|
| 4,627,579 | A | 12/1986 | Rich | |
| 4,809,854 | A * | 3/1989 | Tomaszek | 209/3 |
| 4,830,188 | A * | 5/1989 | Hannigan et al. | 209/3 |
| 4,979,684 | A | 12/1990 | Hoch et al. | |
| 5,054,694 | A | 10/1991 | Knobloch et al. | |
| 5,076,812 | A | 12/1991 | Getsoian | |
| 5,609,256 | A * | 3/1997 | Mankosa | 209/5 |
| 5,637,122 | A | 6/1997 | Brown | |
| 5,678,775 | A * | 10/1997 | Chapman | 241/79.1 |
| 5,865,381 | A * | 2/1999 | Mitsumura et al. | 241/18 |
| 5,876,893 | A * | 3/1999 | Ochiai et al. | 430/111.33 |
| 5,885,330 | A | 3/1999 | Lee | |
| 5,944,875 | A | 8/1999 | Stencel et al. | |
| 2005/0145732 | A1 * | 7/2005 | Oder et al. | 241/119 |

FOREIGN PATENT DOCUMENTS

| | | | |
|---|---|---|---|
| AU | B-44495/93 | | 2/1994 |
| DE | 741883 | | 5/1943 |
| GB | 2 117 667 | A | 10/1983 |
| JP | 57-042355 | A | 3/1982 |
| JP | 2001-246290 | A | 9/2001 |
| RU | 2099143 | C1 * | 12/1997 |
| SU | 365163 | | 1/1973 |
| SU | 1304889 | | 4/1987 |
| WO | WO 02/28537 | A1 | 4/2002 |

OTHER PUBLICATIONS

The International Search Report of the International Searching Authority for PCT Application No. PCT/EP2006/062425 (German and English).

* cited by examiner

*Primary Examiner* — Bena Miller
(74) *Attorney, Agent, or Firm* — Amster, Rothstein & Ebenstein LLP; Craig J. Arnold

(57) ABSTRACT

The invention relates to a method for manufacturing dispersed mineral products by grinding the mineral raw material, sizing the same in a flow classifier, sorting the same in dispersion in air, and eliminating the dispersion air. Also disclosed are devices and installations for carrying out said method.

7 Claims, 4 Drawing Sheets

METHOD AND DEVICE FOR MANUFACTURING DISPERSED MINERAL PRODUCTS

This is a U.S. national phase of PCT Application No. PCT/EP2006/062425, filed May 18, 2006 and claims priority to German Application No. 10 2005 023 950.1, filed May 20, 2005.

The invention relates to a method and a device for manufacturing disperse mineral products by means of a mill, a flow classifier and a system for eliminating the dispersion air.

Natural deposits of mineral raw materials consist out of a mixture of different materials. The mineral materials mined for particular applications, are normally contaminated by a number of different accompanying minerals.

In order to make the mineral raw materials usable, they have to be obtained by mining technology, and the valuable minerals have to be enriched and purified by means of different technological conditioning processes.

The higher the enrichment and the purity of the resource material are in a mineral product, the more valuable it is. This is in particular true for the use of mineral raw materials as high quality fillers in the paper, colour, lacquer, plastics and pharmaceutical industry. The quality of mineral fillers in these application areas is related in the first place to the chemical and mineralogical purity of the products. Accordingly, either very pure deposits of mineral raw materials have to be used for manufacturing fillers, or correspondingly complicated technological conditioning methods for enrichment and purification of the raw materials have to be used.

In case a technological wet-conditioning process is used, the grinded mineral raw material is enriched and purified in an aqueous suspension by flotation, by magnetic separation or by means of density sorting. After purification has been effected, the mineral filler is fine-milled in aqueous suspension, and it is sold as a suspension, as a so called "slurry". From a wet-processed mineral material, also a dry powder could be manufactured, however, the material would have to be drained and thermally dried which, however, is very energy consuming and costly.

For manufacturing of dry, dispersed mineral products, therefore, generally conditioning processes are used in which the mineral raw material is grinded and classified by dry-milling and separation.

Flow classifiers for classifying the mineral products are used in the milling and separation circular flow. The particles produced by milling have to be dispersed in the air and separated for classification in order to achieve an efficient classifying effect in the flow classifier. The products produced by the flow classifier are separated from the air in dust separation installations provided down stream.

Within installations for milling and classifying of mineral materials, therefore, a complete particle dispersion and dedusting system is installed.

Herein, the raw material could, however, not or only very ineffectively be cleaned up to now. Therefore, for manufacturing high quality, dispersed mineral products, in particular fillers, only very pure and high quality starting raw materials could be used which, however, are available only to a limited extend.

The invention is, therefore, based on the object to provide a method and a device according to the preamble of claim 1 in which the mineral raw material is effectively cleaned from foreign particles such that, for manufacturing of high quality, dispersed mineral products, in particular fillers, also less pure starting raw materials can be used.

The solution of this object consists, according to the invention, in that, in between the flow classifier and the air separation system, an electrostatic separation chamber for the separation of foreign particles which are triboelectrically charged in the flow classifier, is installed.

In another context, in connection with other materials and purposes, the electrostatic separation is known per se.

In the patent U.S. Pat. No. 5,885,330 a method for separating unburned carbon material from flue ash is described. Therein, coarse particles are separated from the flue ash by means of a centrifugal force separator, and they are taken up in a separate container. The fine material flow is charged in a separate tribocharging unit which may be constructed in different ways, but, in any case, charges the carbon material particles and the flue ash particles differently. This dispersion containing the differently charged particles falls downwards in a down flow channel between a negatively charged copper plate and a positively charged copper plate. By means of the electrical field between the differently charged plates, the particles, i. e. the carbon material on the one hand and the flue ash on the other hand, which have been charged differently in the tribocharging unit before hand, are separated from each other. By means of cyclones, the separated particles are separated from the gas and are taken up in containers.

According to EP 1,251,964=WO01/52998, plastics waste is electrostatically separated. Therein, a mixture of plastic particles are electrically charged in air in a rotating drum and transferred through sieve holes in the periphery of the drum into a down flow channel in which, on both sides of the downward flow path, plus-/minus-electrodes are provided for the electrostatic separation of the particles according to their different charge.

In both of the above mentioned patents, a separate additional device for the electrostatic charging is necessary after the milling. Furthermore, they are concerned with totally different materials.

In contrast thereto, in the installation of the invention, for charging the particles, the triboelectric charging is used which results from the intensive friction of the solid state particles between one another and the parts of the classifier, in particular the rotor and stator parts of a centrifugal force separator, whereupon the charged particle dispersion, for the electrostatic separation of the contamination from the valuable particles, are directed through an electrostatic separation chamber which is provided in between the flow classifier and the air separation system in the coarse of the procedure.

Furthermore, for amplifying the charging different construction portions of the classifier, in particular housing portions on the one hand and the rotor on the other hand, can be connected to different poles of a direct current source, this being stated in more detail in the sub claims 2 and 3.

Furthermore, the connecting tube between the flow classifier and the electrostatic separation chamber can consist out of electrically conductive material or can be lined or coated therewith, and the electrically conductive parts can be connected to a pole of a direct current source (claim 4).

The electrostatic separation chamber may be inserted into the fine material flow or the coarse material flow of the flow classifier.

Apart from the subsequent electrostatic sorting, the electrostatic charging is also already advantageous for the separation procedure itself since the electro statically charged particles are dispersed in the air stream more uniformly. For a further improvement of the selective charging of the discrete components of the mixture of the mineral material, a part or several movable or static parts of the flow classifier may be made out of a special material or may be coated therewith.

The choice of the material depends on the electron separation force of the mineral material components to be separated, and materials like steel, copper, brass, polytetraflourethylene, polyvynilchloride, aluminium or ceramic materials may be included.

The electron separation force is the force which is necessary to remove an electron out of the upper-most energy band of a solid state atom; it is equal to the difference of the potential energies of an electron between the vacuum level and the Fermi level.

The vacuum level is, therein, equal to the energy of a electron at rest in a larger distance from the surface; the Fermi level is the electrochemical potential of the electrons in a solid state body.

Upon contact of two materials having a different electron separation force, the material with the higher electron separation force (acceptor) is charged negatively, and the material with the lower electron separation force (donator) is charged positively. Therefore, in order to generate a selective charging of different particles of a mineral mixture of raw material, materials with a higher or a lower electron separation force may be used on purpose.

For example, for separating of quartz from calcium-carbonate, the rotor of the classifier may be out of steel, copper or brass since the quartz, because of its higher electron separation force, is charged negatively upon friction contact with steel, copper or brass, and since, on the other hand, the calcium-carbonate, because of its lower electron separation force, is charged positively upon friction contact with steel, copper or brass.

The milling machine is preferably a ball mill, however, also a rod mill, an autogenous mill, a semi-autogenous mill, a roller container mill, a pin mill, an impact mill, a hammer mill, a swing mill, a jet mill, an agitator mill or any other corresponding milling machine may be provided.

For the classification and the triboelectric charging of the grinded mineral material particles, preferably a centrifugal force separator is provided, however, any other kind of flow classifier may be used, for example: an oblige flow separator, a zig-zag separator, a dispersion plate wind separator, an impinging flow separator, a spiral wind separator.

The solid state particles to be separated may, therein, be of any kind, contour, size and source, as long as they are small enough in order to be put into a flow classifier and to be classified therein and to be triboelectrically charged. The separateable solid state particles should have a grain size range of smaller than 10 mm, where, preferably, the average grain size should lay in the range between larger than 2 μm to smaller than 1 mm.

The mineral material powder to be separated may be composed of an arbitrary number and an arbitrary mixture of different mineral material components (valuable materials and contaminations).

The invention is explained in the following in more detail in connection with the drawings with reference to two embodiments of installations.

Figure 1:
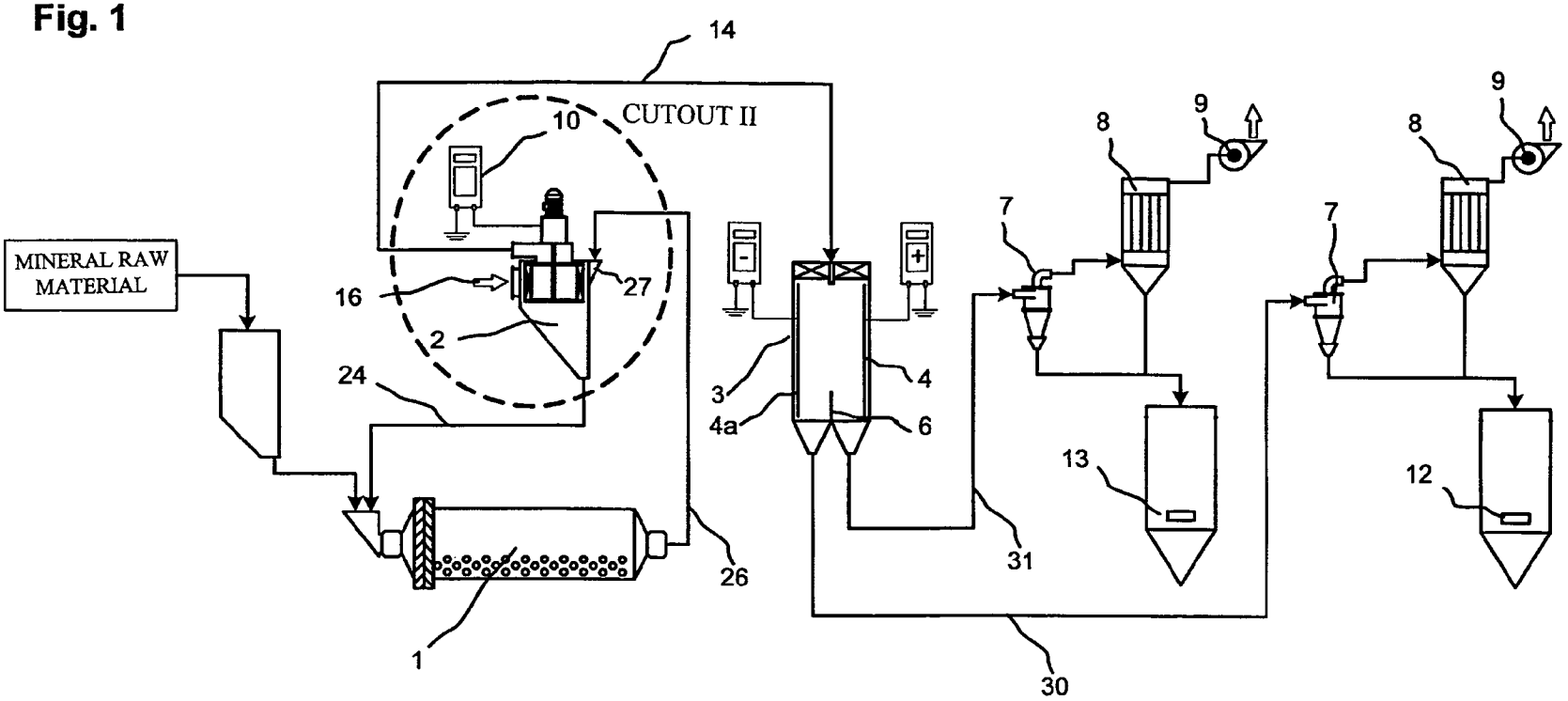
FIG. 1 shows an embodiment in which the electrostatic separation chamber is implemented into the fine material flow of the flow classifier and the coarse material flow is directed back to the inlet of the mill.

The installation according to FIG. 1 contains a ball mill 1 for milling and disintegration of the mineral raw material and a centrifugal force separator 2 which serves, apart from the classification, simultaneously for the triboelectric charging of the grinded mineral material particles according to the invention.

In order to achieve a better triboelectric charging and a higher charge density of the particles flowing through the flow classifier 2, an external electrical direct voltage 10 may be connected to one or several rotating or stationary parts of the flow classifier 2.

Figure 2:
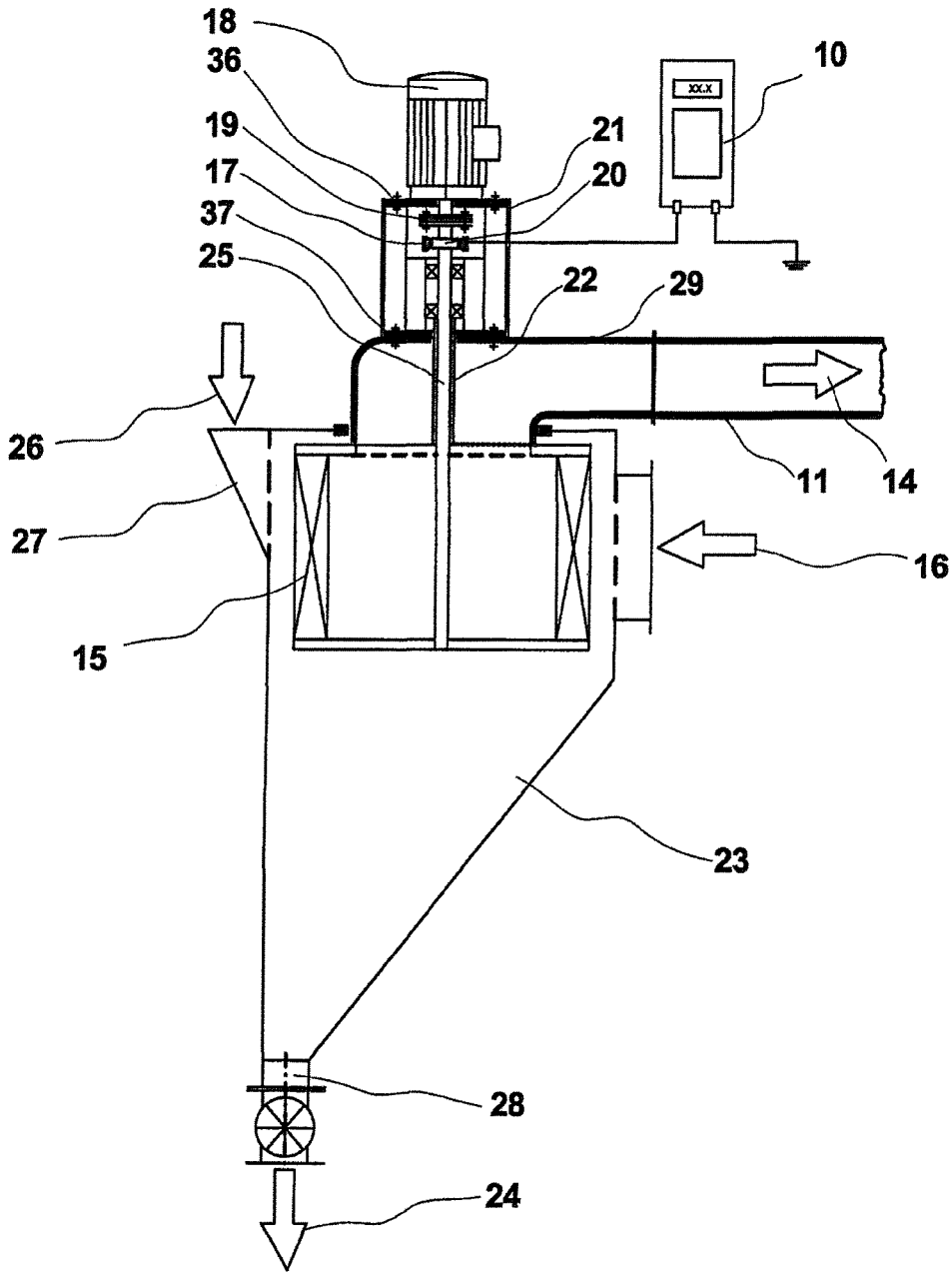
FIG. 2 shows a separator with reference to an enlarged section II of FIG. 1, which separator is connected to a direct current source for amplifying the charging.
Figure 3:
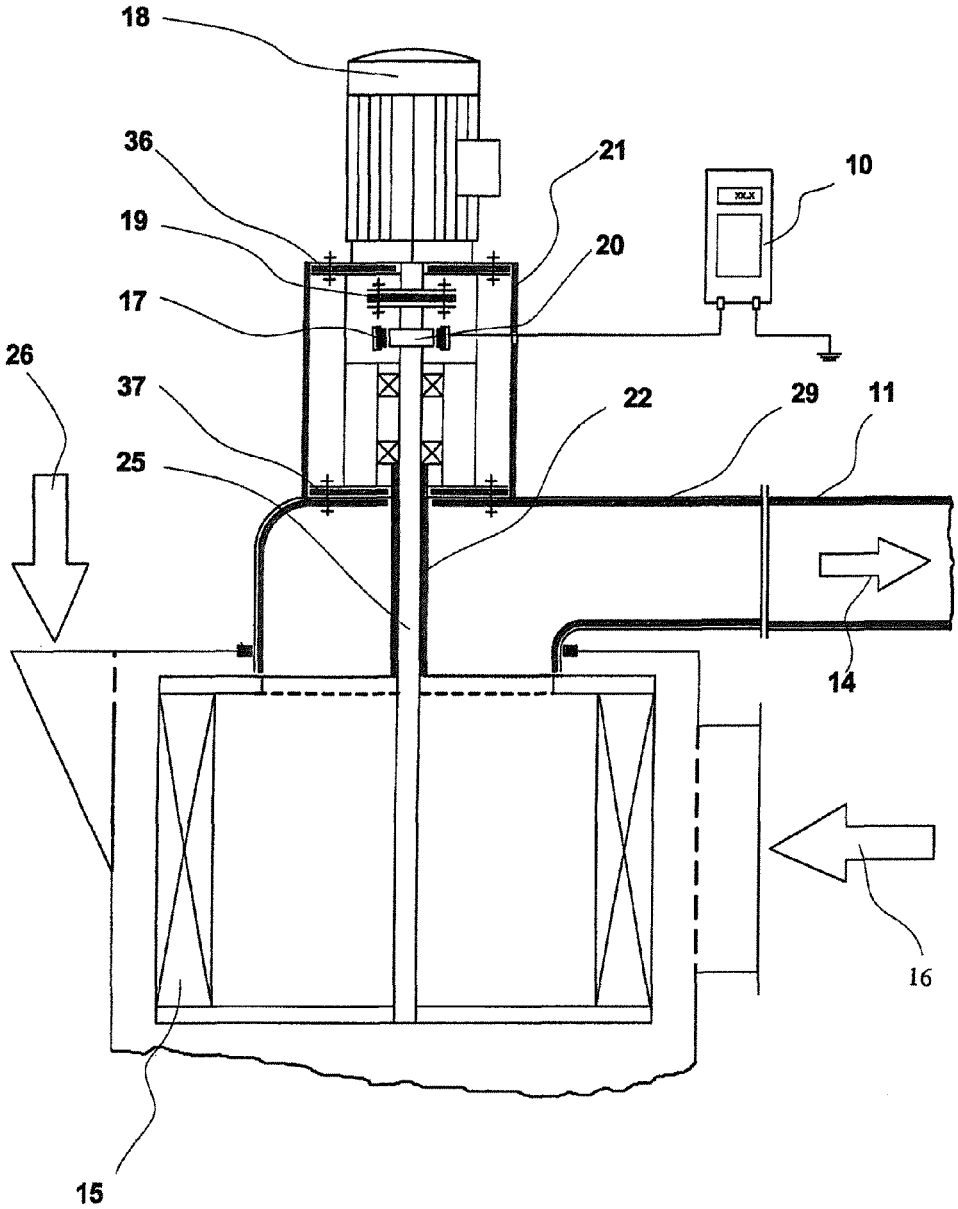
FIG. 3 is an enlargement of FIG. 2 and shows some insulating parts more clearly.

This is shown in more detail in FIG. 2 and FIG. 3.

The separator basket 15 is connected to the driving motor 18 by means of a rotor shaft 25 and a coupling 19. At the rotor shaft 25, there is applied a collector ring 20 which is connected to a pole of a direct current source 10 by means of two coal brushes 17 whereas the other pole is grounded. The electrical voltage output from the direct current source 10 is transferred through the carbon brushes 17 and the commutation ring 20 to the rotor shaft 25 consisting out of an electrically conductive material, and further on to the separator basket 15 conductively fixed to the rotor shaft.

For avoiding an uncontrolled transfer of current from the rotor shaft 25 to the fine material output tube 14, the rotor shaft 25 is covered by the bushing 22 out of electrically non-conductive material in the area of penetration through the fine material output tube 14.

The fine material output tube is furthermore protected through the electrical insulating layer 37 against uncontrolled current transitions.

At the side of the motor, the rotor shaft 25 subjected to a direct voltage, is separated from the driving motor 18 by means of the electrically insulated coupling 19 and the electrical insulation layer 36.

The parts carrying voltage, in the area of the bearing of the rotor shaft 25 and the commutation ring 20 are separated from the surrounding by means of an electrically non-conductive protective housing 23.

The fine material output tube 14 of the separator is also insulated from the separator housing 23 by means of an electrically non-conductive insulation layer 29.

The separation air is input through the separation air inlet 16 and the grinded mineral powder 26 is input through the input opening 27 into the separation space, and is dispersed by the turbulent air flow 25 present in the separation space.

The particles dispersed in the air, follow the air flow in the separation space and have to flow through the separator basket 15 which is rotating fast. Thereby, an intensive contact and friction of the particles with respect to the blades of the separator basket 15 and, thereby, the triboelectrostatic charging of the mineral material powder occurs. Coarse mineral particles cannot flow through the separator basket 15 but are rejected thereby. Therein, also an intensive contact and a friction with the separator basket 15 and the separator housing 23 and, thereby, also a triboelectric charging of the coarse mineral material particles 24 occurs which are discharged from the separator through the coarse material outlet 28.

In a further embodiment (not shown here) for amplifying the triboelectric charging of the material particles and the contaminations, the separator basket 15 is covered with a material the electron separation force of which lies in between the electron separation force of the material and that of the contamination. In the same way, the fine material output tube 14 may be made out of a material the electron separation force of which lies in between the electron separation force of the material and that of the contamination.

Furthermore, also the connecting tube 11 between the flow classifier to and the separation chamber 3 may be connected to the pole of the direct current source 10.

The charged fine material flow 32 gets to an electrostatic separation chamber 3 which is preferably arranged vertically and which is provided with separation electrodes 4, 4*a*.

In the electrostatic separation chamber 3, the charged fine material dispersion is separated into a dispersion flow 30 containing the purified product, and the dispersion flow 31 containing the separated foreign particles.

The two separated dispersion flows 30 and 31 are directed through a system each for separating the air. These two air separation systems consist for example out of a separator cyclone 7 and/or a dust filter 8 and a blower 9 which generates the required air flow for the dispersion and transport of the mineral material particles through the flow classifier by means of a sub-pressure.

The purified mineral powder gets into container 12, the separated foreign particle powder gets to another container 13.

Figure 4:
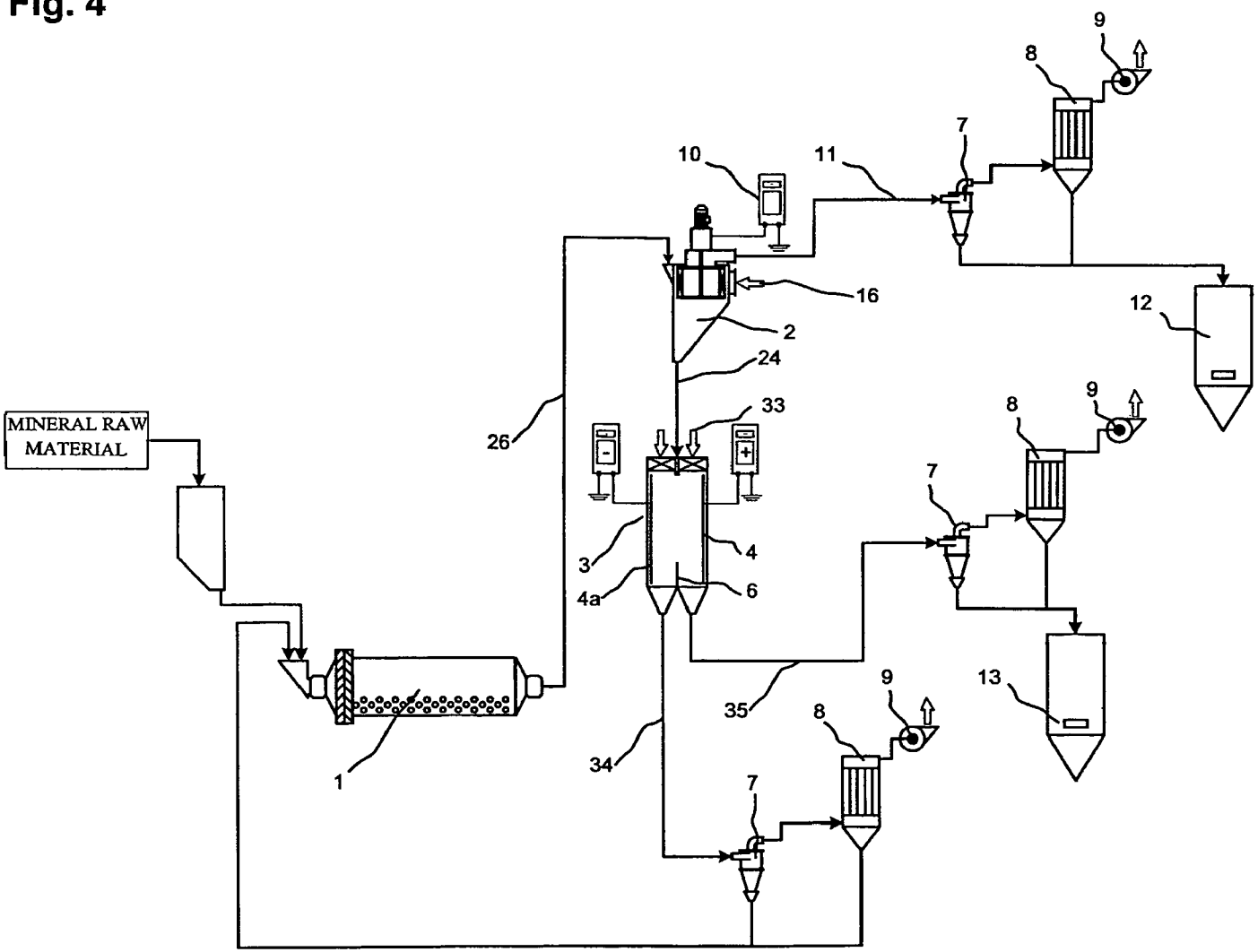
FIG. 4 shows an embodiment in which the separation chamber is implemented into the coarse material flow of the flow classifier.

FIG. 4 shows an embodiment in which the fine material flow of the separator 2 is the final product whereas the coarse material flow 24 of the flow classifier is directed to an electrostatic separation chamber 3 upon supplying the required air 33.

Therein, the coarse material dispersion is divided up into two partial flows of which one partial flow 34 containing the valuable particles, is directed back to the input of the mill whereas the other partial flow 35 containing the foreign particles, is—after separation of the dispersion air—further processed as waste or by product.

As to the rest, FIG. 4 corresponds essentially to FIG. 1, the same parts being provided with the same reference signs.

The invention claimed is:

1. An installation for enriching a mineral material for use as a filler in the paper, colour, lacquer, plastic or pharmaceutical industry, used in combination with the mineral material, the installation comprising a mill that grinds the mineral material, a flow classifier that classifies and triboelectrically charges the grinded mineral material, an electrostatic separation chamber that separates the triboelectrically charged mineral material into desired mineral particles and contaminating foreign particles, and an air separation system that separates dispersion air, wherein the electrostatic separator chamber is installed between the flow classifier and the air separation system.

2. The installation according to claim 1, wherein at least a part of the flow classifier is connected to a pole of a direct current source that triboelectric charges the grinded mineral material.

3. The installation according to claim 1, wherein the flow classifier is a centrifugal force separator and at least a rotor part of the separator and/or at least a stator part of the separator is/are connected to a pole of a direct current source.

4. The installation according to claim 1, wherein the flow classifier and the electrostatic separation chamber are connected by a connecting tube lined or coated with an electrically conductive material connected to a pole of a direct current source.

5. The installation according to claim 1, wherein the electrostatic separation chamber is arranged to receive fine material flow of the flow classifier.

6. The installation according to claim 1, wherein the electrostatic separation chamber is arranged to receive coarse material flow of the flow classifier.

7. The installation according to claim 1, wherein at least a movable or static part of the flow classifier comprises steel, copper, brass, polytetraflourethylene, polyvinylchloride, aluminium or a ceramic material or is covered therewith.

* * * * *